US009794677B2

(12) United States Patent
Shetye et al.

(10) Patent No.: US 9,794,677 B2
(45) Date of Patent: Oct. 17, 2017

(54) HEADPHONE

(71) Applicant: Bose Corporation, Framingham, MA (US)

(72) Inventors: Mihir D. Shetye, Framingham, MA (US); Ryan C. Silvestri, Franklin, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/993,607

(22) Filed: Jan. 12, 2016

(65) Prior Publication Data

US 2017/0201823 A1 Jul. 13, 2017

(51) Int. Cl.

*H04R 1/10* (2006.01)
*H04R 1/26* (2006.01)
*H04R 5/033* (2006.01)

(52) U.S. Cl.

CPC ..... *H04R 1/1091* (2013.01); *H04R 1/1075* (2013.01); *H04R 1/26* (2013.01); *H04R 5/0335* (2013.01); *H04R 2205/022* (2013.01); *H04R 2205/024* (2013.01)

(58) Field of Classification Search

CPC .... H04R 1/1091; H04R 1/1041; H04R 5/033; H04R 3/00; H04R 5/0335; H04R 1/1066; H04R 1/1075

USPC ..... 381/74

See application file for complete search history.

(56) References Cited

U.S. PATENT DOCUMENTS 5,617,477 A 4/1997 Boyden
5,682,434 A 10/1997 Boyden
6,301,367 B1 * 10/2001 Boyden ..... A42B 1/245 381/376
9,100,732 B1 8/2015 Dong et al.
2001/0031062 A1 * 10/2001 Terai ..... H04R 5/033 381/370
2009/0154755 A1 6/2009 Yamagishi et al.

FOREIGN PATENT DOCUMENTS

EP 1122978 A2 8/2001
WO 2011031910 A1 3/2011

OTHER PUBLICATIONS

The International Search Report and the Written Opinion of the International Searching Authority dated Mar. 31, 2017 for PCT Application No. PCT/US2017/012925.

* cited by examiner

*Primary Examiner* — Paul S Kim
(74) *Attorney, Agent, or Firm* — Brian M. Dingman; Dingman IP Law, PC

(57) ABSTRACT

A headphone that has a support structure that is adapted to sit on a head or upper torso of a user, a first acoustic driver carried by the support structure such that the first acoustic driver is located off of an ear of the user, wherein the first acoustic driver has front and rear sides and sound is radiated from both sides of the first acoustic driver, and a structure that defines a first acoustic chamber on the front side of the first acoustic driver and with at least one opening therein, and a second acoustic chamber on the rear side of the first acoustic driver and with at least one opening therein. At low frequencies a polar pattern of the first acoustic driver behaves approximately like a dipole, and at high frequencies a polar pattern of the first acoustic driver exhibits a higher order directional pattern. A second acoustic driver can be included.

23 Claims, 10 Drawing Sheets

HEADPHONE

BACKGROUND

This disclosure relates to a headphone.

Headphones are typically located in, on or over the ears. One result is that outside sound is occluded. This has an effect on the wearer's ability to participate in conversations as well as the wearer's environmental/situational awareness. It is thus desirable at least in some situations to allow outside sounds to reach the ears of a person using headphones.

Headphones can be designed to sit off the ears so as to allow outside sounds to reach the wearer's ears. However, in such cases sounds produced by the headphones can become audible to others. When headphones are not located on or in the ears, it would be best to inhibit sounds produced by the headphones from being audible to others.

SUMMARY

The headphones disclosed herein have one or more acoustic drivers. Sound is radiated from both the front and rear sides of the driver diaphragm. The drivers are located off the ear, so that the wearer can hear conversations and other environmental sounds. In a single driver implementation the driver is arranged such that it is symmetrically loaded in the front and back. Symmetric loading of the driver causes it to behave approximately like a dipole at low frequencies, and thus the sound cancels in the far field. To achieve a higher order directional pattern at high frequencies, a resistive mesh can be symmetrically applied on the driver. However, this can reduce its low frequency output. At high frequencies the symmetrically loaded driver exhibits a higher order directional pattern such as a cardioid or hypercardioid; the single driver can thus exhibit directionality at high frequencies. This can allow the user to hear the sounds while preventing the sounds from being heard by others.

In a dual driver configuration a high frequency driver is positioned closer to the ear than a low frequency driver, and a control module switches between the low frequency driver and high frequency driver at a crossover frequency that is selected based on the optimal combination of sufficient output to equalize and the aim to obtain a higher order directional pattern in the desired frequency range. In one particular non-limiting example, this crossover frequency is about 500 Hz. The low frequency driver behaves like a dipole and the high frequency driver has a higher order directional pattern. Thus, this configuration effectively achieves a similar effect as the single driver implementation, while maintaining low frequency output. And, as in the single driver implementation, both the high frequency and low frequency drivers could be floating near the ear, or they could be positioned above/behind the ear with a port that directs sound toward the ear.

All examples and features mentioned below can be combined in any technically possible way.

In one aspect, a headphone includes a support structure that is adapted to sit on a head or upper torso of a user, and an acoustic driver carried by the support structure such that the acoustic driver is located off of an ear of the user. The acoustic driver has front and rear sides and sound is radiated from both sides of the acoustic driver. There is a structure that defines a first acoustic chamber on the front side of the acoustic driver and a second acoustic chamber on the rear side of the acoustic driver, wherein the first acoustic chamber has at least one opening therein and the second acoustic chamber has at least one opening therein. At low frequencies a polar pattern of the acoustic driver behaves approximately like a dipole, and at high frequencies a polar pattern of the acoustic driver exhibits a higher order directional pattern. The higher order directional pattern may comprise one of: a cardioid or a hypercardioid.

Embodiments may include one of the following features, or any combination thereof. The headphone may further comprise a baffle adjacent to the acoustic driver. The headphone may further comprise a housing for the acoustic driver, where the acoustic driver is located inside of the housing. The housing may be located above or behind an ear of a user. The housing may comprise a first port that is acoustically coupled to the front of the acoustic driver and a second port that is acoustically coupled to the rear of the acoustic driver.

Embodiments may include one of the following features, or any combination thereof. The front side of the driver, the first acoustic chamber and the at least one opening in the first acoustic chamber together may have a first effective impedance, and the rear side of the driver, the second acoustic chamber and the at least one opening in the second acoustic chamber together may have a second effective impedance. In one example the ratio of the first effective impedance to the second effective impedance ranges from approximately 0.95 to approximately 1.05 at frequencies ranging from about 20 Hz to about 2 kHz. In another example the ratio of the first effective impedance to the second effective impedance is less than approximately 0.95 at frequencies above about 2 kHz.

Embodiments may include one of the following features, or any combination thereof. The headphone may further comprise an acoustic resistance material proximate to one or more, or all of the openings in the first and second acoustic chambers. The acoustic resistance material may comprise at least one of: a plastic, a textile, a metal, a permeable material, a woven material, a screen material, and a mesh material. The acoustic resistance material may have an acoustic impedance that ranges from about 5 MKS Rayls to about 100 MKS Rayls.

Embodiments may include one of the following features, or any combination thereof. The structure that defines the first and second acoustic chambers may comprise a first device surrounding the front side of the driver and a second device surrounding the rear side of the driver. The first and second devices may each comprise a basket. The acoustic impedances of the front and rear sides of the acoustic driver may be approximately equal. The first and second acoustic chambers may each have a plurality of openings therein. The openings in the first acoustic chamber and the openings in the second acoustic chamber may be configured to have approximately the same equivalent impedance, such that the acoustic driver is symmetrically loaded.

In another aspect, a headphone includes a support structure that is adapted to sit on a head or upper torso of a user, an acoustic driver carried by the support structure such that the acoustic driver is located off of an ear of the user and outside of the pinna when viewed in the sagittal plane, a first device defining a first acoustic chamber on the front side of the first acoustic driver, the first device having at least one opening therein, a second device defining a second acoustic chamber on the rear side of the first acoustic driver, the second device having at least one opening therein, and a body extending from the first device, where the body covers a portion of the pinna when viewed from the sagittal plane.

Embodiments may include one of the following features, or any combination thereof. The openings in the first and second devices may be configured to have approximately the same overall acoustic impedance. At low frequencies, a polar pattern of the acoustic driver may behave approximately like a dipole, and at high frequencies, a polar pattern of the acoustic driver may exhibit a higher order directional pattern; the higher order directional pattern may comprise one of: a cardioid or a hypercardioid.

In another aspect, a headphone includes a support structure that is adapted to sit on a head or upper torso of a user, an acoustic driver carried by the support structure such that the acoustic driver is located off of an ear of the user, wherein the acoustic driver has front and rear sides and sound is radiated from both sides of the acoustic driver, and a structure that defines a first acoustic chamber on the front side of the acoustic driver and a second acoustic chamber on the rear side of the acoustic driver, wherein the first acoustic chamber has at least one opening therein and the second acoustic chamber has at least one opening therein. There is a housing for the acoustic driver, where the acoustic driver is located inside of the housing, and wherein the housing comprises a first port that is acoustically coupled to the front of the acoustic driver and a second port that is acoustically coupled to the rear of the acoustic driver. The front side of the driver, the first acoustic chamber, and the at least one opening in the first acoustic chamber together have a first effective impedance, and the rear side of the driver, the second acoustic chamber, and the at least one opening in the second acoustic chamber together have a second effective impedance. The ratio of the first effective impedance to the second effective impedance ranges from approximately 0.95 to approximately 1.05 at frequencies ranging from about 20 Hz to about 2 kHz. At low frequencies, a polar pattern of the acoustic driver behaves approximately like a dipole, and at high frequencies, a polar pattern of the acoustic driver exhibits a higher order directional pattern.

In another aspect, a headphone includes a support structure that is adapted to sit on a head or upper torso of a user, a low frequency acoustic driver carried by the support structure such that the low frequency acoustic driver is located off of an ear of the user, wherein the low frequency acoustic driver has front and rear sides, a high frequency acoustic driver carried by the support structure such that the high frequency acoustic driver is located off of the ear of the user and is located closer to the ear than the first acoustic driver, wherein the high frequency driver has front and rear sides, and a controller that is configured to enable the low frequency driver to acoustically output sound in a first frequency range and enable the high frequency driver to acoustically output sound in a second frequency range, the second frequency range being higher than the first frequency range.

Embodiments may include one of the following features, or any combination thereof. A polar pattern of the low frequency acoustic driver may behave approximately like a dipole. A polar pattern of the high frequency acoustic driver may exhibit a higher order directional pattern, which may comprise one of: a cardioid or a hypercardioid. The first frequency range may comprise frequencies below about 500 Hz and the second frequency range may comprise frequencies above about 500 Hz.

Embodiments may include one of the following features, or any combination thereof. The high frequency driver may be enclosed by a housing defining a rear chamber acoustically coupled to the rear side of the high frequency driver. The headphone may further comprise a port in the rear side of the housing acoustically coupling the rear chamber to an environment external to the headphone. The headphone may further comprise an acoustic resistance material proximate to the port. The acoustic resistance material may comprise at least one of: a plastic, a textile, a metal, a permeable material, a woven material, a screen material, and a mesh material. The acoustic resistance material may have an acoustic impedance that ranges from about 5 MKS Rayls to about 500 MKS Rayls.

Embodiments may include one of the following features, or any combination thereof. The low frequency driver may be enclosed by a housing defining a front chamber acoustically coupled to the front side of the low frequency driver, and a rear chamber acoustically coupled to the rear side of the low frequency driver. The housing may comprise a first port that is acoustically coupled to the front chamber and a second port that is acoustically coupled to the rear chamber. The headphone may further comprise a baffle adjacent to the high frequency acoustic driver. The crossover frequency may be selected based on a combination of an output of the low frequency driver and a higher order directional pattern from the high frequency driver.

Embodiments may include one of the following features, or any combination thereof. The low frequency driver may be located off an ear of the user and outside of the pinna when viewed in the sagittal plane. The headphone may further comprise a body that covers a portion of the pinna when viewed from the sagittal plane. The high frequency driver may be carried by the body. The body may be a baffle.

In another aspect a headphone includes a support structure that is adapted to sit on a head or upper torso of a user, a low frequency acoustic driver carried by the support structure such that the low frequency acoustic driver is located off of an ear of the user, wherein a polar pattern of the low frequency acoustic driver behaves approximately like a dipole, a high frequency acoustic driver carried by the support structure such that the high frequency acoustic driver is located off of the ear of the user and is located closer to the ear than the first acoustic driver, wherein a polar pattern of the high frequency acoustic driver exhibits a higher order directional pattern comprising one of: a cardioid or a hypercardioid. The high frequency driver is enclosed by a housing defining a rear chamber acoustically coupled to a rear side of the high frequency driver, and further comprising a port in the rear side of the housing acoustically coupling the rear chamber to an environment external to the headphone. There is a controller that is configured to enable the low frequency driver to acoustically output sound in a first frequency range and enable the high frequency driver to acoustically output sound in a second frequency range, the second frequency range being higher than the first frequency range. The headphone may further comprise an acoustic resistance material proximate to the port, wherein the acoustic resistance material has an acoustic impedance that ranges from about 5 MKS Rayls to about 500 MKS Rayls.

In another aspect a headphone includes a support structure that is adapted to sit on a head or upper torso of a user, a low frequency acoustic driver carried by the support structure such that the low frequency acoustic driver is located off of an ear of the user, wherein a polar pattern of the low frequency acoustic driver behaves approximately like a dipole. The low frequency driver is enclosed by a first housing defining a front chamber acoustically coupled to a front side of the low frequency driver and a rear chamber acoustically coupled to a rear side of the low frequency driver, and the first housing comprises a first port that is acoustically coupled to the front chamber and a second port that is acoustically coupled to the rear chamber. There is a high frequency acoustic driver carried by the support structure such that the high frequency acoustic driver is located off of the ear of the user and is located closer to the ear than the first acoustic driver, wherein a polar pattern of the high frequency acoustic driver exhibits a higher order directional pattern comprising one of: a cardioid or a hypercardioid. The high frequency driver is enclosed by a second housing defining a rear chamber acoustically coupled to a rear side of the high frequency driver, and further comprising a port in the rear side of the second housing acoustically coupling the rear chamber to an environment external to the headphone. A controller is configured to enable the low frequency driver to acoustically output sound in a first frequency range and enable the high frequency driver to acoustically output sound in a second frequency range, the second frequency range being higher than the first frequency range.

Embodiments may include one of the following features, or any combination thereof. The low frequency driver may be located outside of the pinna when viewed in the sagittal plane. The headphone may further comprise a body that covers a portion of the pinna when viewed from the sagittal plane. The high frequency driver may be carried by the body.

DETAILED DESCRIPTION

Figure 1:
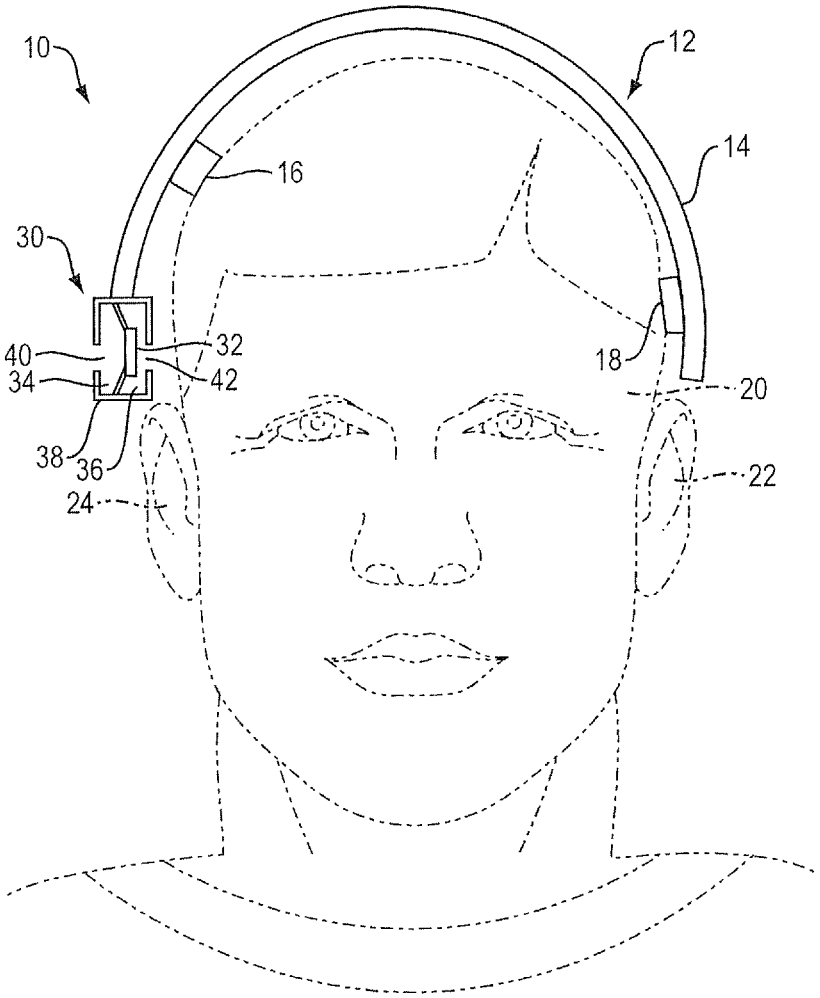
FIG. 1 is a schematic partially cross-sectional view of a headphone.

The headphone herein can have one or more acoustic drivers. The drivers are located off the ear (typically, either off the head but close to the ear, or on or about the neck/upper torso) so that the wearer can hear conversations and other environmental sounds. The headphone herein is in some examples adapted to play wide bandwidth audio. In cases in which the headphone is designed to focus on the speech band only, the low frequency driver may not be needed. In a single driver implementation of the headphones, there are structures in front of and in back of the driver. These structures have the same or approximately the same equivalent acoustic impedance, such that the driver is symmetrically loaded. Symmetric loading of the driver maintains the dipole behavior to higher frequencies, above which the driver exhibits a higher order directional pattern such as a cardioid or hypercardioid. The single driver can thus exhibit directionality at high frequencies. This design allows the user to hear the sounds that are produced by the headphones while preventing the sounds from being heard by others, and still allowing the user to hear conversation and environmental sounds.

In one example symmetric loading of the driver is accomplished by arranging baskets in front of and in back of the driver so as to define front and rear acoustic cavities. There are one or more openings in each basket. The front and rear openings can be configured to have approximately the same equivalent acoustic impedance. This can be achieved by, for example, modifying one or more of the length and cross sectional area of the openings, and/or by including an acoustic resistance material in the openings. There can be any number or size of openings, as long as the equivalent impedance on both sides is matched. The openings can carry an optional acoustic resistance material so as to tailor the equivalent acoustic resistance. In this configuration the driver behaves like a dipole at low frequencies and has a higher order directional pattern at high frequencies.

In one example there can be ports in the housing on the front and rear of the driver. Symmetric loading can be facilitated by matching the impedance of the ports. This can be achieved by, for example, modifying one or more of the length and cross sectional area of the ports, and/or by including an acoustic resistance material in the ports. In this implementation, the driver could be floating near the ear or positioned above/behind the ear with a port In an implementation with two drivers the low frequency driver does not need to have an acoustic impedance that is matched on the front and back of the driver as it is in the single driver implementation. The high frequency driver can also be a standard driver that radiates sound from both the front and back surfaces of the driver diaphragm. The high frequency driver can have a rear cavity port in the housing; this port is typically but not necessarily covered by an acoustic mesh material so as to tune the acoustic impedance. The high frequency driver can be positioned closer to the ear than the low frequency driver. In this implementation, a control module would switch between the low frequency driver and high frequency driver at a crossover frequency that is selected based on the optimal combination of sufficient output to equalize and the aim to obtain a higher order directional pattern in the desired frequency range. In some cases there are ports associated with the low frequency driver that are designed such that below the crossover frequency the low frequency driver radiates like a dipole. In one particular non-limiting example, the crossover frequency is about 500 Hz. The low frequency driver behaves like a dipole and the high frequency driver has a higher order directional pattern. Thus, this configuration effectively achieves a similar sound radiation effect as the single driver implementation, while maintaining a desired low frequency output. And, as in the single driver implementation, both the high frequency and low frequency drivers could be floating near the ear, or they could be positioned above/behind the ear with a port that directs sound toward the ear.

Headphone 10, FIG. 1, includes support structure 12 that is adapted to sit on a head 20, or alternatively the upper torso or neck, of a user. Support structure 12 in this non-limiting example includes headband 14 that sits on head 20 and carries audio unit 30 that produces sound that is heard by the user through one or both ears 22 and 24. One audio unit is shown, proximate one ear, but there could be two audio units, one close to (typically off of, above or behind) each ear. Audio unit 30 is carried such that it does not touch ear 24. One result is that the user can still hear conversations and other environmental sounds, even while also hearing sounds emanating from audio unit 30. Cushions or standoffs 16 and 18 are one non-limiting means of maintaining a position of audio unit 30 such that it is off of ear 24. Other constructions of support structure 12 that can be coupled to the body and maintains the audio unit relatively close to but not touching the ear would be apparent to those skilled in the art and are included within the scope of the present disclosure. One non-limiting example of another style of support structure would be a nape band that is constructed and arranged to be worn around the neck/shoulders area, with audio units that project sound toward the ears.

Audio unit 30 includes acoustic transducer (driver) 32. Driver 32 has front and rear sides, and sound is radiated from both sides of driver 32. Driver 32 can be any type of driver now known or hereafter developed that is able to radiate sound from the front and the rear. Driver 32 is located inside of structure 38. Structure 38 is sufficiently open such that it defines a first acoustic chamber 34 on the front side of the driver 32 and second acoustic chamber 36 on the rear side of driver 32. Chamber 34 has one or more front openings 40 from which sound can exit, and chamber 36 has one or more rear openings 42 from which sound can exit. At low frequencies (typically but not necessarily meaning frequencies up to about 500 Hz or perhaps around 1000 Hz), a polar pattern of driver 32 behaves approximately like a dipole, and at high frequencies (typically but not necessarily over about 500 Hz), a polar pattern of driver 32 exhibits a higher order directional pattern. Examples of such higher order directional patterns include cardioid and hypercardioid patterns, as further explained below. The entire audio unit 30 may be enclosed in a housing or other structure.

In some examples, the acoustic impedances of the front and rear sides of driver 32 are approximately equal. In some examples, openings 40 and 42 are configured to have approximately the same acoustic impedance; preferably the first and second openings or ports are configured to have an acoustic impedance ratio of less than approximately 1.1. Opening 40 and chamber 34 have an effective impedance of "Zfront" while opening 42 and chamber 36 along with the back cavity impedance of driver 32 have an effective impedance "Zback." In one non-limiting example the acoustic impedance ratio Zfront/Zback ranges from approximately 0.95 to approximately 1.05 in the frequency range of about 20 Hz to about 2 kHz, and is less than approximately 0.95 above about 2 kHz. The ratio range from 20-2000 Hz is desirable to maintain dipole behavior and hence extend the bandwidth of far-field cancellation. In higher frequencies, it is desirable to reduce the radiation from the back and achieve a cardioid/hyper-cardioid pattern as the sound radiated to the environment in these frequencies is perceived to be more annoying. In some examples, there is an acoustic resistance material proximate to (e.g., covering or filling) each of openings 40 and 42. In non-limiting examples the acoustic resistance material comprises at least one of a plastic, a textile, a metal, a permeable material, a woven material, a screen material, and a mesh material. The mesh material has an acoustic impedance. The acoustic impedance should be such that it has minimal effect on low frequency output while providing for high directionality at high frequencies. In non-limiting examples, particularly for use with a single driver, the acoustic resistance material has an acoustic impedance that ranges from about 5 MKS Rayls to about 100 MKS Rayls. Matching the equivalent acoustic impedances of the front and rear sides of driver 32 aids in maximizing the low frequency dipole behavior of driver 32.

Figure 2A:
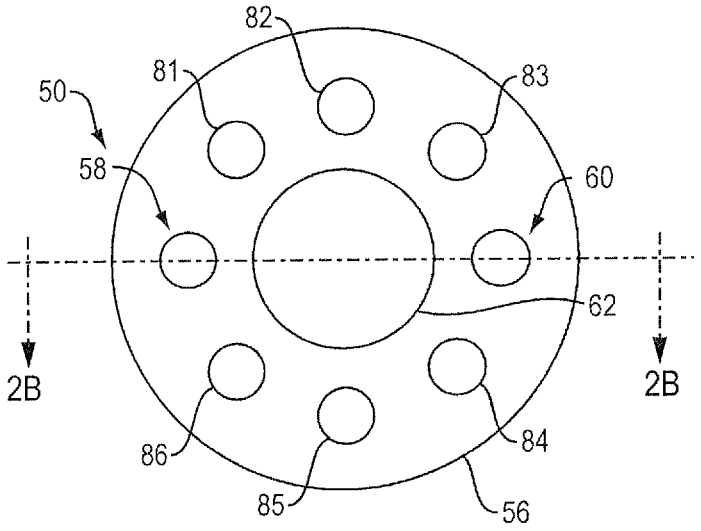
FIG. 2A is a bottom view of an audio unit for a headphone.
Figure 2B:
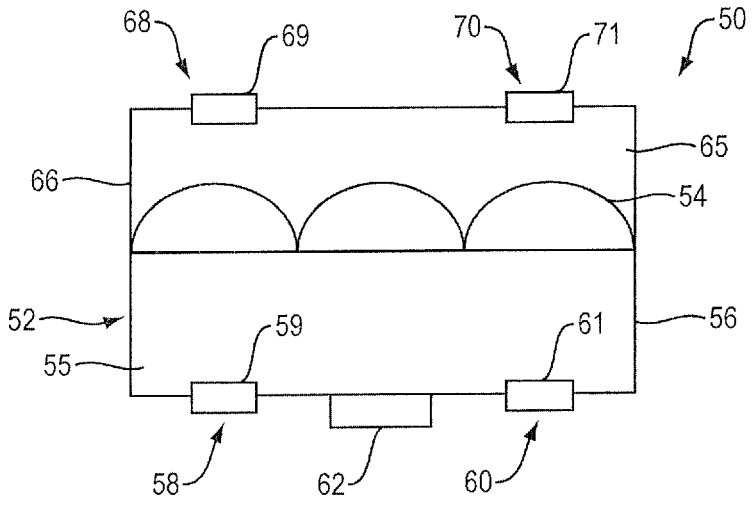
FIG. 2B is a cross-sectional view taken along line 2B-2B of FIG. 2A.

FIG. 2A is a bottom view of an audio unit 50 that can be used in the headphone. FIG. 2B is a cross-sectional view taken along line 2B-2B of FIG. 2A. Audio unit 50 includes a driver 52 that includes diaphragm/surround 54, magnet/coil assembly 62 and structure or basket 56. Rear acoustic chamber 55 is located behind diaphragm 54. Openings 58, 60 and 81-86 are formed in the rear side of basket 56. There can be one or more such openings. The area of each opening, and the area of the openings in total, is selected to achieve a desired acoustic impedance at the rear of the driver. The openings may also comprise tubes, and the length of each tube may be selected to achieve a desired acoustic impedance at the rear of the driver. In non-limiting examples acoustic resistance material 59 is located in or over opening 58 and acoustic resistance material 61 is located in or over opening 60. Typically but not necessarily each of the openings is covered by an acoustic resistance material, so as to develop a particular acoustic impedance at the rear of the driver.

In one example the acoustic impedances at the rear and the front of the driver are approximately the same to achieve a wider bandwidth of far-field cancellation. This can be accomplished by including a second basket or structure 66 located in front of and surrounding diaphragm/surround 54 such that acoustic chamber 65 is formed in the front of the driver. Basket 66 can be but need not be the same as basket 56, and can include the same openings and the same acoustic resistance material in the openings, so as to create the same acoustic impedances in the front and rear of the driver. Openings 68 and 70 filled with acoustic resistance material 69 and 71 are shown, to schematically illustrate this aspect. The acoustic resistance material helps to control a desired acoustic impedance to achieve a dipole pattern at low frequencies and a higher-order directional pattern at high frequencies. However, the increased impedance may result in decreased low frequency output.

Figure 3A:
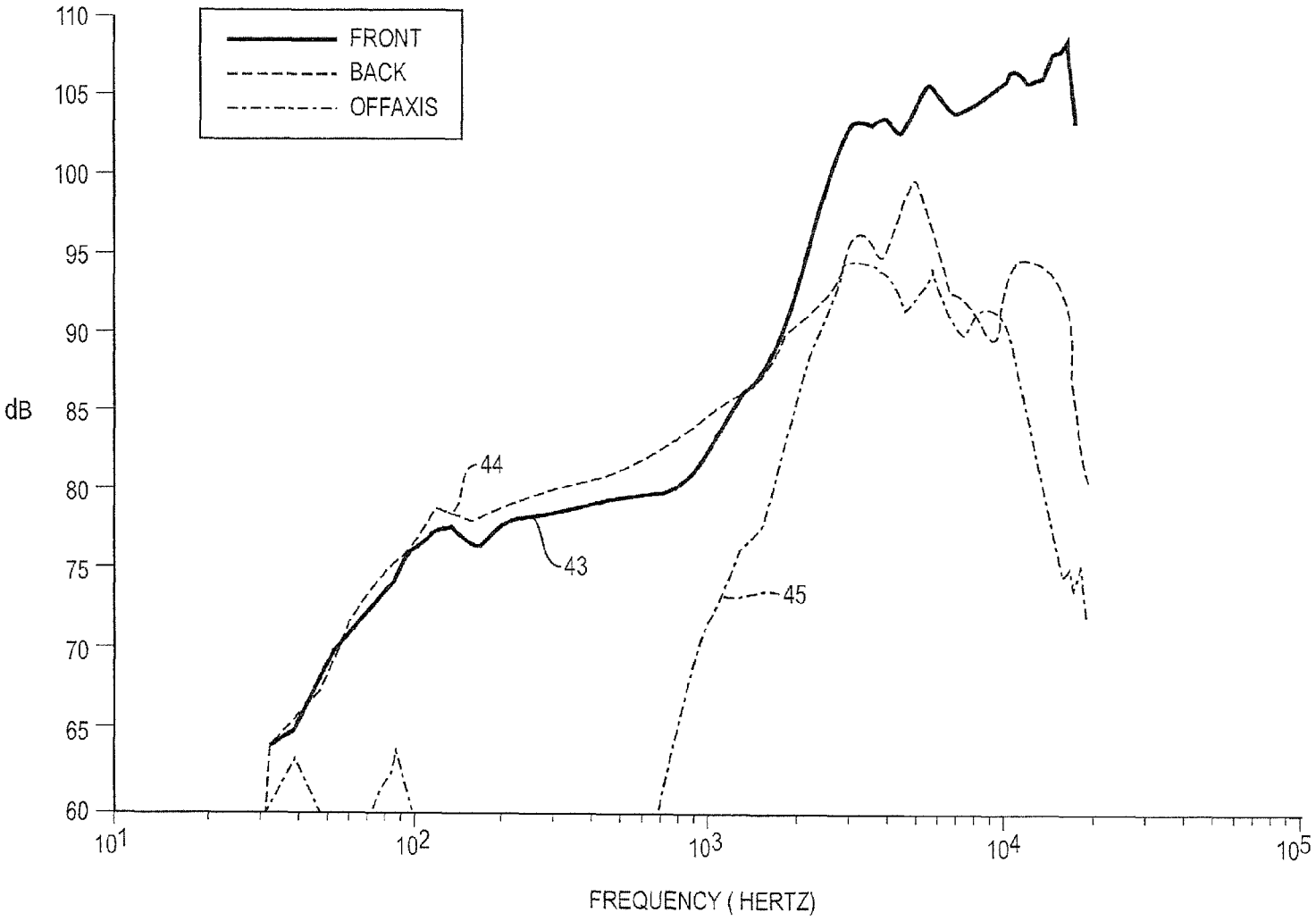
FIG. 3A is a plot of the front, back and off-axis radiation from a prior art acoustic driver.

FIG. 3A illustrates the front (curve 43), back (curve 44) and 90 degree off-axis (curve 45) radiation from an exemplary acoustic driver such as driver 52, FIG. 2A, with a rear basket with openings covered with mesh, but in this case without front basket 66 (which results in the front of the driver being open). At high frequencies (in this case, above about 1,000 Hz) the front and back radiations are not matched in magnitude, and the off-axis radiation measured at 90 degrees has a relatively large magnitude. In this situation, sound radiated from the acoustic driver would more likely become audible to persons not wearing the acoustic driver, but located near or around the acoustic driver.

Figure 3B:
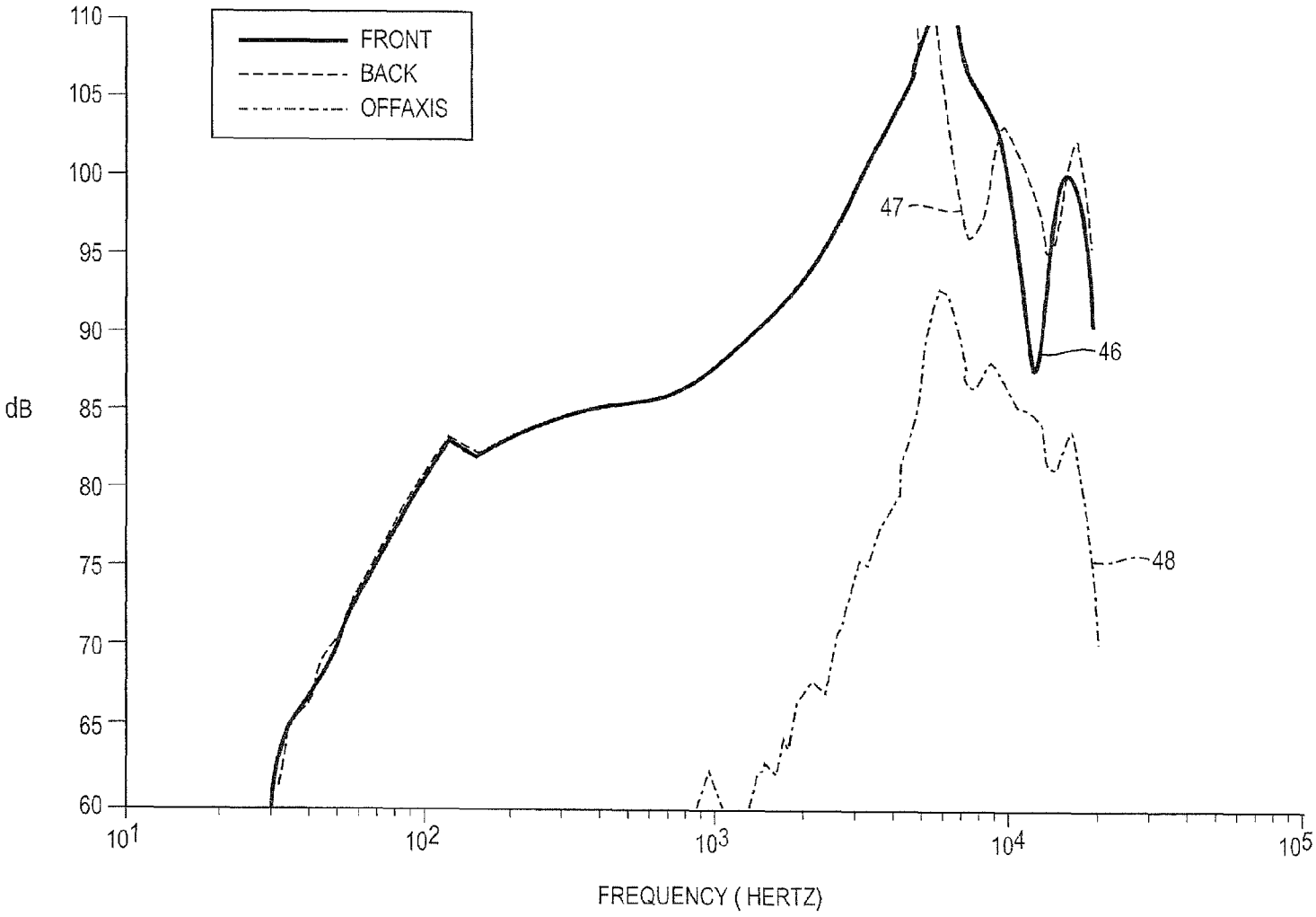
FIG. 3B illustrates the front, back and off-axis radiation from the audio unit of FIG. 2.

FIG. 3B illustrates the front (curve 46), back (curve 47) and 90 degree off-axis (curve 48) radiation from audio unit 30, FIGS. 2A and 2B (i.e., including front basket 66), but with both the front and rear baskets 66, 56 having unblocked openings (i.e., without any acoustic resistance material in the openings of the front and rear acoustic chambers) that have approximately the same equivalent impedance. The front and back radiations are well matched up to around 4-5 kHz, while the off-axis radiation has a smaller magnitude.

The data of FIGS. 3A and 3B illustrate that matched acoustic impedances at the front and rear of the driver help to maintain a dipole pattern for a wider bandwidth, and exhibit directionality at higher frequencies, and results in sound output reduction in the far field. The data also illustrate a tradeoff of using the mesh (loss of low frequency output, but higher directionality at high frequencies)

Figure 4B:
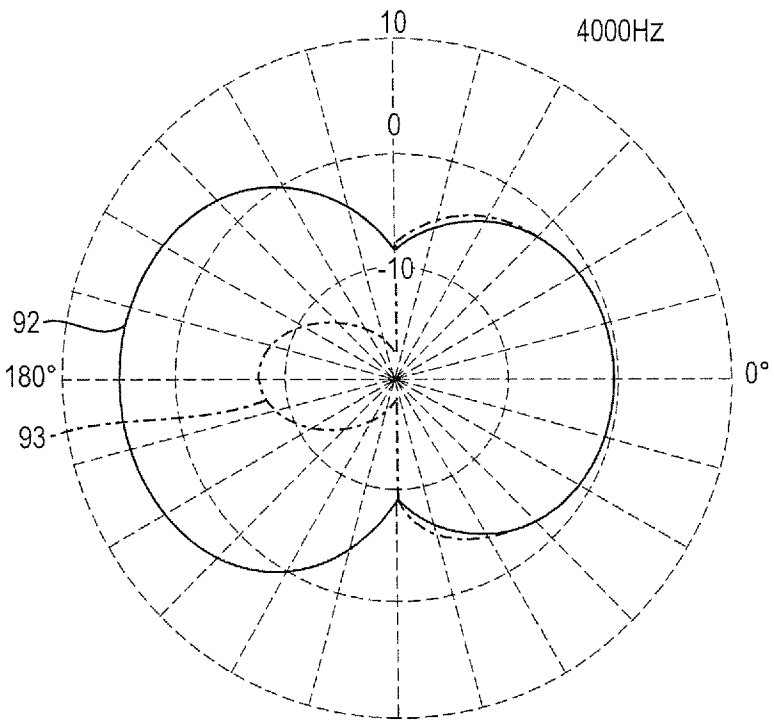
FIGS. 4A and 4B are polar plots of the output of the driver of the audio unit of FIG. 2 at two different frequencies.
Figure 4A:
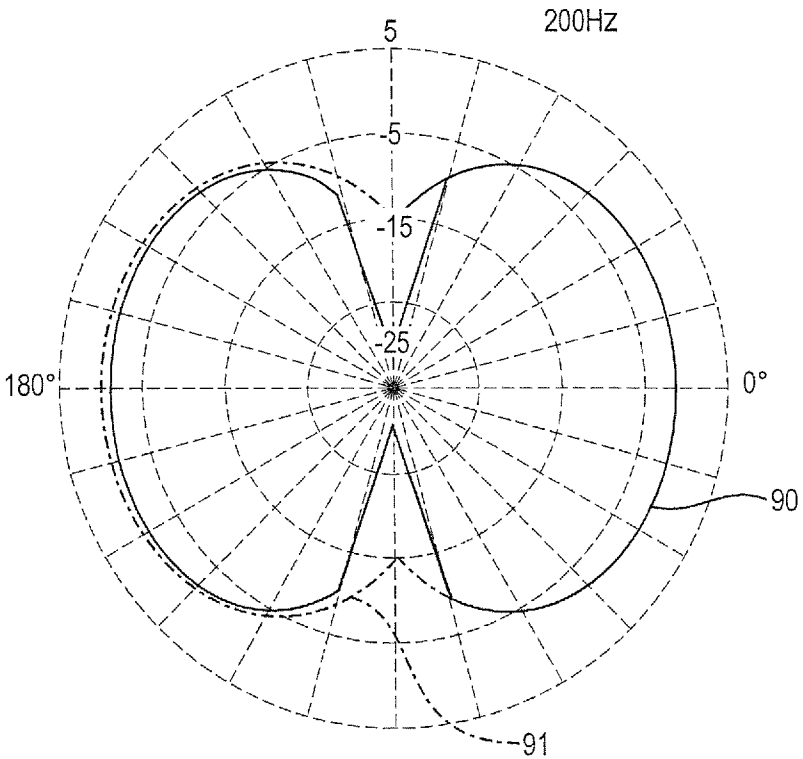

At low frequencies acoustic drivers frequently exhibit a dipole radiation pattern wherein sound is radiated in opposite directions, 180 degrees out of phase. FIGS. 4A and 4B are polar plots of the output of a driver such as driver 52, FIG. 2A, with and without an acoustic resistance mesh material over the rear chamber openings. The plots of FIG. 4A were taken at 200 Hz and show typical dipole radiation without mesh (curve 90) and with mesh (curve 91). The plot of FIG. 4B was taken from the same driver at 4000 Hz and with mesh (curve 93) shows a hypercardioid pattern with significantly greater radiation at 0 degrees (the front side) as compared to 180 degrees (the rear side), resulting in less radiation to the far field. Without mesh (curve 92) the pattern is closer to a dipole. This illustrates an example of a single driver implementation of the subject headphone, wherein at low frequencies sound is cancelled in the far field and at high frequencies most of the sound energy is directed into the ear of a wearer rather than in other directions.

Figure 5:
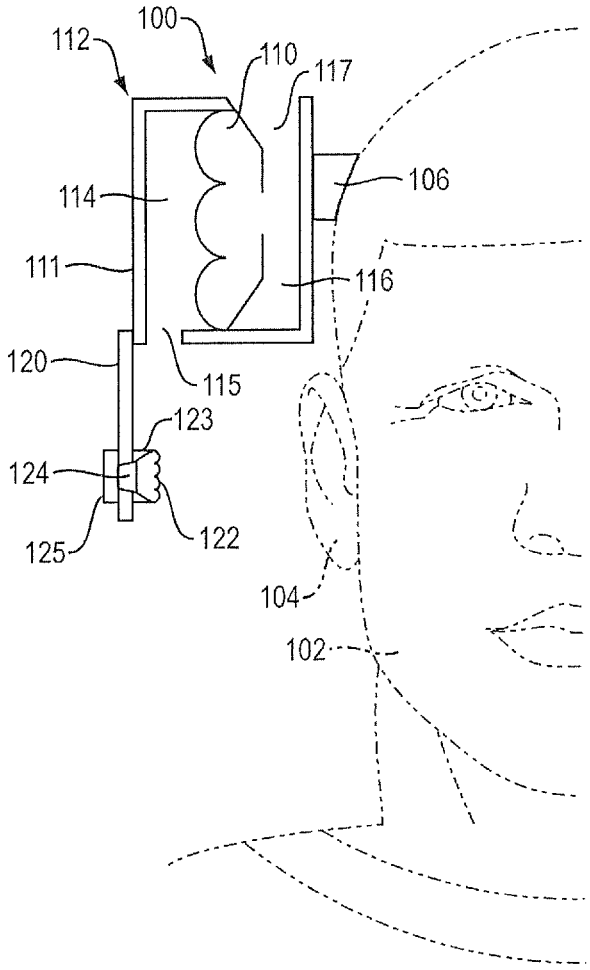
FIG. 5 is a schematic partially cross-sectional view of another headphone.

Another exemplary headphone is shown in FIG. 5, which illustrates both a configuration for a single driver headphone and a configuration for a dual driver headphone. Headphone 100 includes audio unit 112 that is held off of ear 104 via support structure 106 that sits on head 102. In other examples, support structure 106 may be adapted to sit on the upper torso or neck of a user. Audio unit 112 includes first acoustic driver 110 that is located within housing 111. Housing 111 can be but need not be located above or behind ear 104. Housing 111 defines front acoustic chamber 114 and rear acoustic chamber 116. There may be a first port 115 that is acoustically coupled to the front of first acoustic driver 110 and is located such that it is generally close to ear 104 and so directs sound toward the ear, and a second port 117 that is acoustically coupled to the rear of first acoustic driver 110 and is located such that it is farther from ear 104 than is port 115 and radiates 180 degrees out of phase with the sound from port 115. Ports 115 and 117 may be but need not be configured to have approximately the same acoustic impedance. This can be achieved by, for example, modifying one or more of the length and cross sectional area of the ports, and/or by including an acoustic resistance material in the ports. Ports 115 and 117 may have but need not have an acoustic resistance material proximate to the port. When such a material is used it can be at least one of a plastic, a textile, a metal, a permeable material, a woven material, a screen material, and a mesh material. When such material is used it can have an acoustic impedance that ranges from about 5 MKS Rayls to about 500 MKS Rayls.

Headphone 100 may (but need not) also include in this non-limiting example a body or baffle 120 adjacent to driver 110 and extending from housing 111 downward toward the transverse plane of the ear, but on the side of port 115 farthest from the ear. In one non-limiting example baffle 120 extends from housing 11 such that it covers a portion of the pinna when viewed from the sagittal plane. The baffle is acoustically opaque. In this case baffle 120 is located adjacent to port 115. Baffle 120 is effective to constrain and re-direct radiation leaving port 115. Baffle 120 can be effective to direct more of the radiation leaving port 115 toward ear 104 as compared to a headphone without a baffle.

Headphone 100 in this non-limiting example may (but need not) also include a second acoustic driver 122. However, headphone 100 can be configured as a single driver headphone with only driver 110 in housing 111 that has ports 115 and 117, and may (or may not) include baffle 120. When second driver 122 is present, it can be carried by the support structure such that the second acoustic driver 122 is closer to the ear than is the first acoustic driver 110. One non-limiting manner of achieving this result is to arrange the headphone such that second driver 122 is carried by or otherwise mechanically coupled to baffle 120. Driver 122 is preferably mounted such that it radiates directly toward ear 104. Preferably as well, housing 123 for driver 122 includes rear port 124 with resistive mesh 125. When baffle 120 is arranged to cover about half of ear 104 (e.g., the top half, as shown in the drawing), driver 122 can be located directly in front of but spaced from ear 104.

In one example, first acoustic driver 110 is a low frequency driver that exhibits a dipole radiation pattern, and second acoustic driver 122 is a high frequency driver that exhibits a higher order directional pattern, such as a cardioid or a hypercardioid. A controller or processor may switch between the two drivers 110, 122 based on the frequency of the sound to be output by the headphone 100. For example, at low frequencies (e.g., frequencies at or below approximately 500 Hz) the controller or processor may select the low frequency driver 110 to acoustically output sound. At such low frequencies, the low frequency driver 110 behaves as a dipole, radiating sound in opposite directions, 180 degrees out of phase, which results in far field sound cancellation. At high frequencies (e.g., frequencies above approximately 500 Hz), the controller or processor may select the high frequency driver 122 to acoustically output sound. At such high frequencies, the high frequency driver 122 exhibits a higher order directional pattern, which results in more sound energy being directed towards the ear of a user of the headphone 100 rather than in other (undesirable) directions (such as towards persons who are not wearing the headphone, but who are located within the vicinity of the headphone).

Figure 6A:
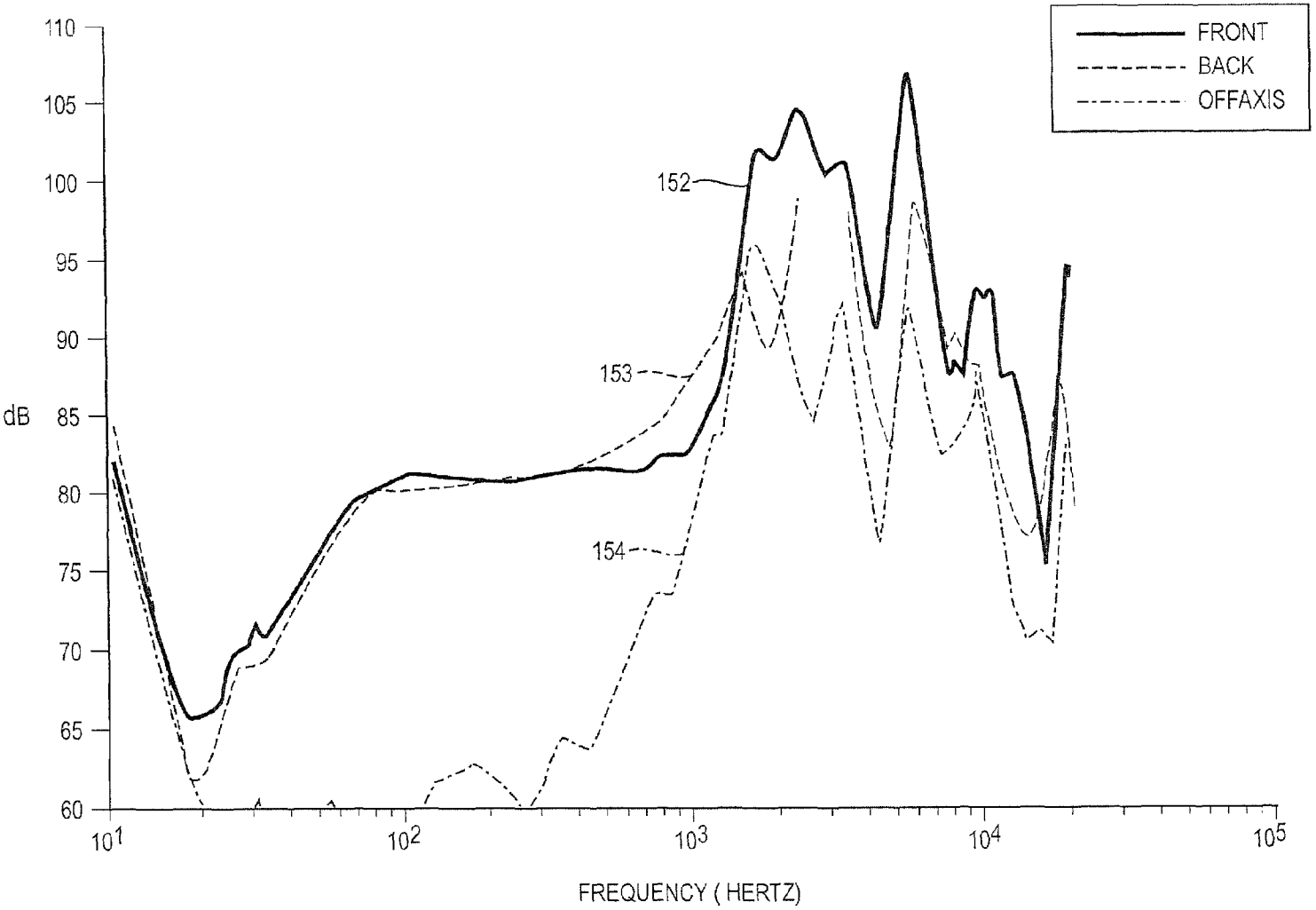
FIG. 6A is a plot illustrating dipole behavior of the low frequency driver of the headphone of FIG. 5.
Figure 6B:
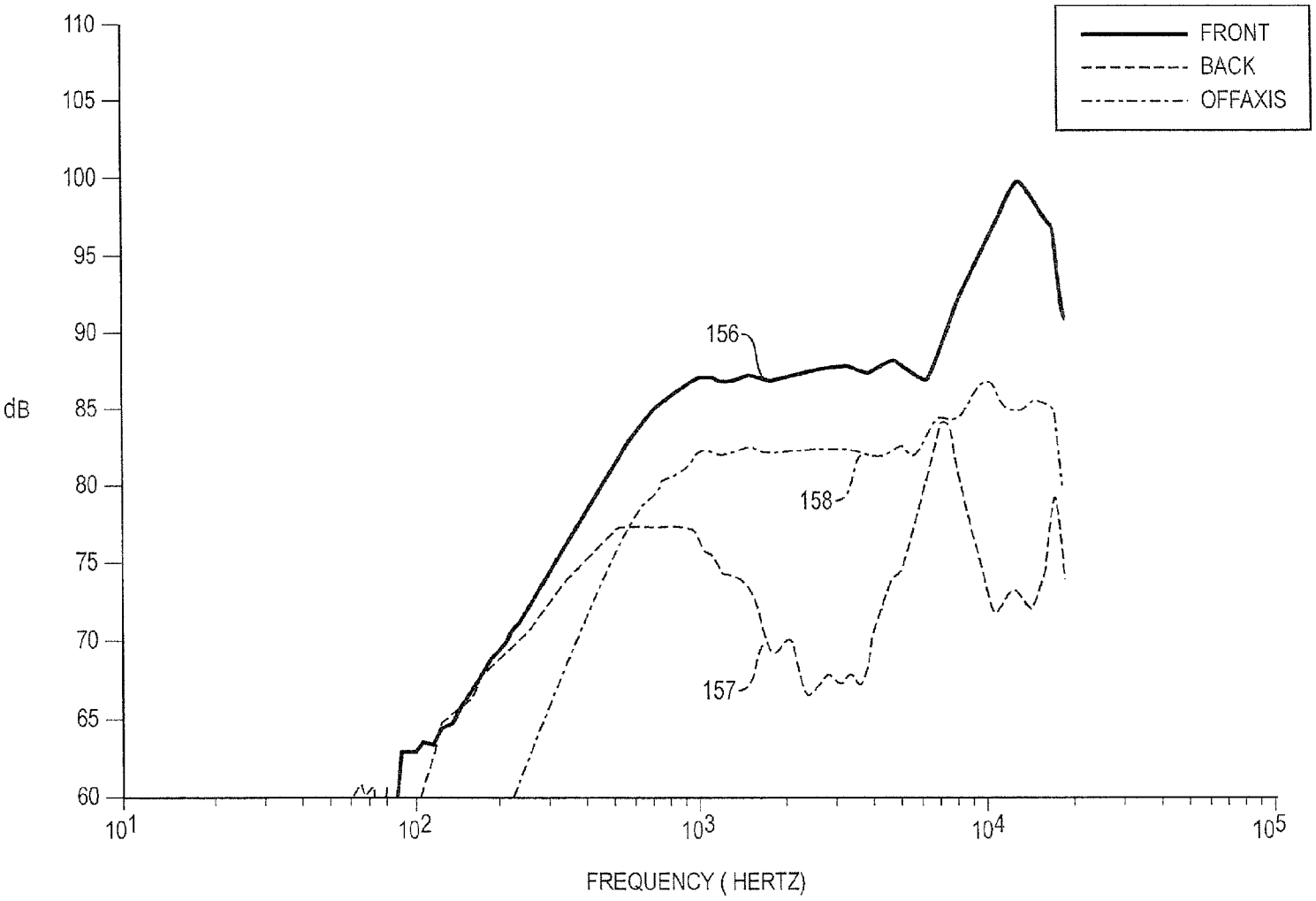
FIG. 6B is a plot illustrating directional behavior of the high frequency driver of the headphone of FIG. 5.

FIG. 6A illustrates the sound emanating from front port 115 (curve 152), the sound emanating from rear port 117 (curve 153), and sound measured at 90 degrees off axis (curve 154). Dipole behavior at low frequencies is evident. FIG. 6B illustrates the sound emanating from the front of high frequency driver 122 (curve 156), the sound emanating from the rear port 124 of high frequency driver 122 (curve 157), and the off-axis sound measured at 90 degrees off axis (curve 158). Highly directional behavior is evident.

Figure 7:
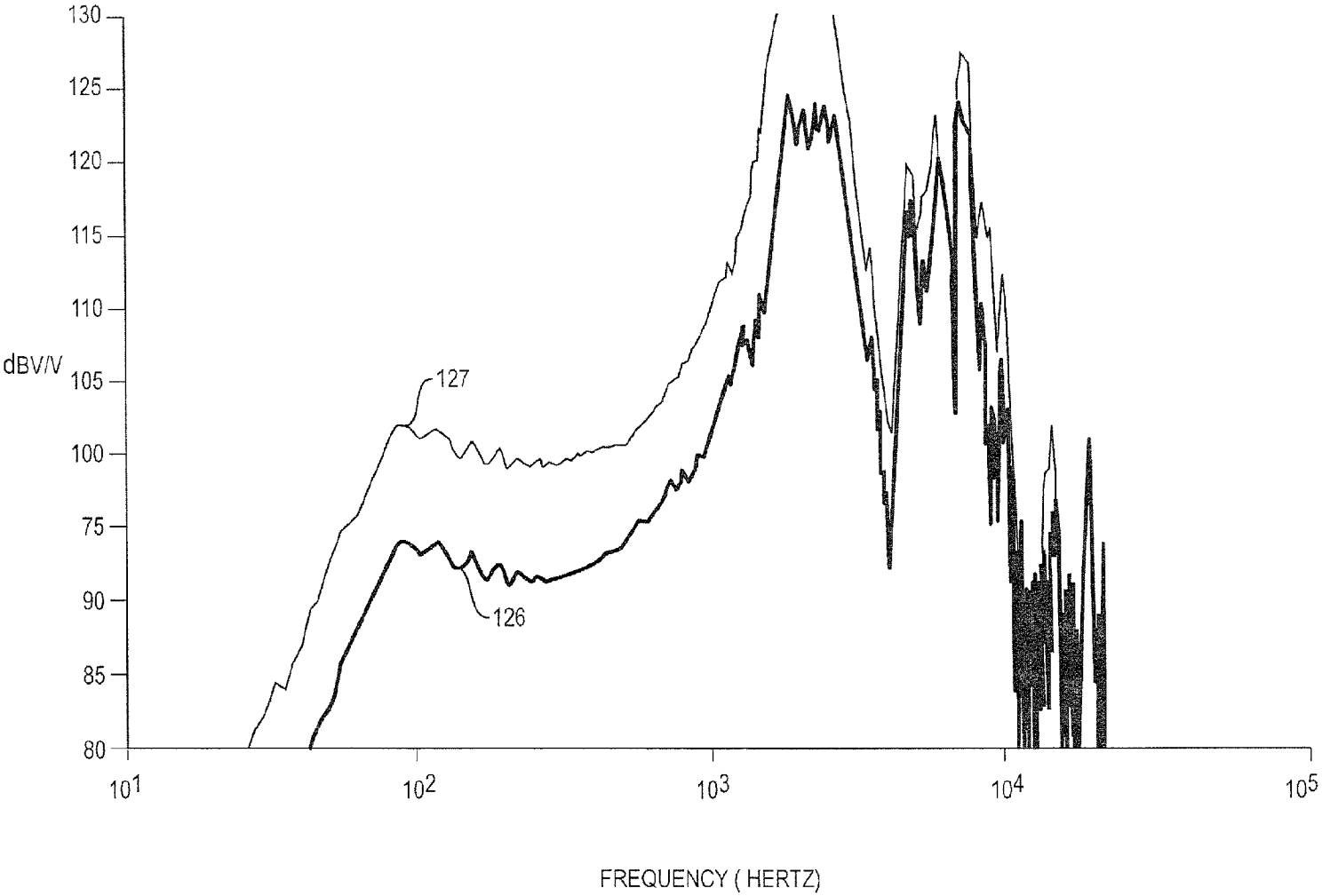
FIG. 7 is a plot of the sound received at the ear for two different configurations of the headphone of FIG. 5 and illustrates an advantage of using a baffle to increase low frequency output.

FIG. 7 illustrates the emanated sound for two different configurations of a headphone such as headphone 100, FIG. 5, but with only a single driver 110 (i.e., without driver 122). One configuration has baffle 120, and the other configuration does not have baffle 120. Curve 127 is a plot of sound pressure level vs. frequency for the configuration with baffle 120. Curve 126 is without the baffle. As shown, the baffle increases the magnitude of sound output significantly, particularly at frequencies up to around 1000 Hz to 2000 Hz.

Figure 8:
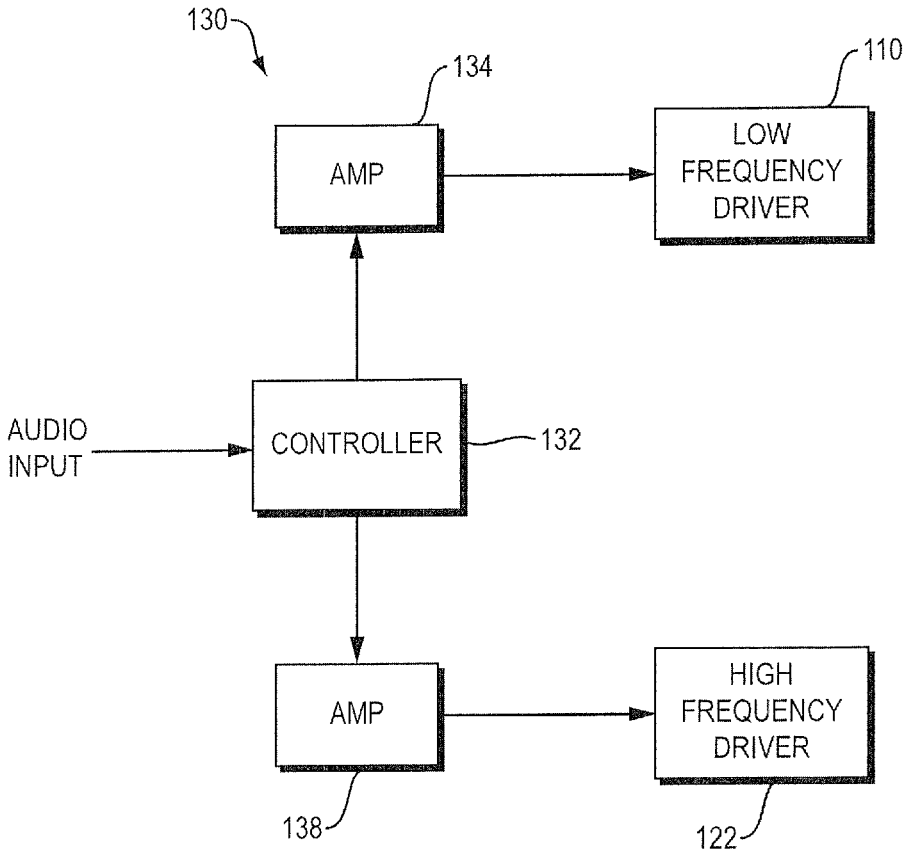
FIG. 8 is a schematic block diagram of a control system for the headphone of FIG. 5.

FIG. 8 is a schematic block diagram of a control system for the headphone of FIG. 5 that includes a crossover system for the two drivers. Audio input is provided to controller 132. Controller 132 switches between low frequency driver 110 and high frequency driver 122 at a crossover frequency. The crossover frequency can be selected based on the optimal combination of sufficient output to equalize and the goal to achieve a higher order directional pattern in the desired frequency range. The signals are amplified by amplifiers 134 and 138 and provided to drivers 110 and 122. In one non-limiting example the crossover frequency is at about 500 Hz. At frequencies up to about 500 Hz low frequency driver 110 behaves like a dipole and thus sound is cancelled in the far field. At frequencies greater than about 500 Hz driver 122 has a higher order directional pattern (e.g., a cardioid or a hypercardioid) such that most of the sound energy is directed into ear 104 rather than in other directions. The dual driver system achieves the desired low frequency output for wideband audio and maintains high directionality at high frequencies.

The control system of FIG. 8 may be implemented with discrete electronics, by software code running on a digital signal processor (DSP) or any other suitable processor within or in communication with the headphone or headphones.

Elements of figures are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system. When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A headphone comprising:

a support structure that is adapted to sit on a head or upper torso of a user;

a low frequency acoustic driver carried by the support structure such that the low frequency acoustic driver is located off of an ear of the user, wherein the low frequency acoustic driver has front and rear sides;

a high frequency acoustic driver carried by the support structure such that the high frequency acoustic driver is located off of the ear of the user and is located closer to the ear than the first acoustic driver, wherein the high frequency driver has front and rear sides; and a controller that is configured to enable the low frequency driver to acoustically output sound in a first frequency range and enable the high frequency driver to acoustically output sound in a second frequency range, the second frequency range being higher than the first frequency range.

2. The headphone of claim 1, wherein a polar pattern of the low frequency acoustic driver behaves approximately like a dipole.

3. The headphone of claim 1, wherein a polar pattern of the high frequency acoustic driver exhibits a higher order directional pattern.

4. The headphone of claim 3, wherein the higher order directional pattern comprises one of: a cardioid or a hypercardioid.

5. The headphone of claim 1, wherein the first frequency range comprises frequencies below about 500 Hz and the second frequency range comprises frequencies above about 500 Hz.

6. The headphone of claim 1, wherein the high frequency driver is enclosed by a housing defining a rear chamber acoustically coupled to the rear side of the high frequency driver.

7. The headphone of claim 6, further comprising a port in the rear side of the housing acoustically coupling the rear chamber to an environment external to the headphone.

8. The headphone of claim 7, further comprising an acoustic resistance material proximate to the port.

9. The headphone of claim 8, wherein the acoustic resistance material comprises at least one of: a plastic, a textile, a metal, a permeable material, a woven material, a screen material, and a mesh material.

10. The headphone of claim 8, wherein the acoustic resistance material has an acoustic impedance that ranges from about 5 MKS Rayls to about 500 MKS Rayls.

11. The headphone of claim 1, wherein the low frequency driver is enclosed by a housing defining:

a front chamber acoustically coupled to the front side of the low frequency driver; and a rear chamber acoustically coupled to the rear side of the low frequency driver;

wherein the housing comprises a first port that is acoustically coupled to the front chamber and a second port that is acoustically coupled to the rear chamber.

12. The headphone of claim 1, further comprising a baffle adjacent to the high frequency acoustic driver.

13. The headphone of claim 1, wherein the crossover frequency is selected based on a combination of an output of the low frequency driver and a higher order directional pattern from the high frequency driver.

14. The headphone of claim 1, wherein the low frequency driver is located off an ear of the user and outside of the pinna when viewed in the sagittal plane.

15. The headphone of claim 14, further comprising a body that covers a portion of the pinna when viewed from the sagittal plane.

16. The headphone of claim 15, wherein the high frequency driver is carried by the body.

17. The headphone of claim 16, wherein the body comprises a baffle.

18. A headphone comprising:

a support structure that is adapted to sit on a head or upper torso of a user;

a low frequency acoustic driver carried by the support structure such that the low frequency acoustic driver is located off of an ear of the user, wherein a polar pattern of the low frequency acoustic driver behaves approximately like a dipole;

a high frequency acoustic driver carried by the support structure such that the high frequency acoustic driver is located off of the ear of the user and is located closer to the ear than the first acoustic driver, wherein a polar pattern of the high frequency acoustic driver exhibits a higher order directional pattern comprising one of: a cardioid or a hypercardioid;

wherein the high frequency driver is enclosed by a housing defining a rear chamber acoustically coupled to a rear side of the high frequency driver, and further comprising a port in the rear side of the housing acoustically coupling the rear chamber to an environment external to the headphone; and a controller that is configured to enable the low frequency driver to acoustically output sound in a first frequency range and enable the high frequency driver to acoustically output sound in a second frequency range, the second frequency range being higher than the first frequency range.

19. The headphone of claim 18, further comprising an acoustic resistance material proximate to the port, wherein the acoustic resistance material has an acoustic impedance that ranges from about 5 MKS Rayls to about 500 MKS Rayls.

20. A headphone comprising:

a support structure that is adapted to sit on a head or upper torso of a user;

a low frequency acoustic driver carried by the support structure such that the low frequency acoustic driver is located off of an ear of the user, wherein a polar pattern of the low frequency acoustic driver behaves approximately like a dipole;

wherein the low frequency driver is enclosed by a first housing defining a front chamber acoustically coupled to a front side of the low frequency driver and a rear chamber acoustically coupled to a rear side of the low frequency driver, and wherein the first housing comprises a first port that is acoustically coupled to the front chamber and a second port that is acoustically coupled to the rear chamber;

a high frequency acoustic driver carried by the support structure such that the high frequency acoustic driver is located off of the ear of the user and is located closer to the ear than the first acoustic driver, wherein a polar pattern of the high frequency acoustic driver exhibits a higher order directional pattern comprising one of: a cardioid or a hypercardioid;

wherein the high frequency driver is enclosed by a second housing defining a rear chamber acoustically coupled to a rear side of the high frequency driver, and further comprising a port in the rear side of the second housing acoustically coupling the rear chamber to an environment external to the headphone; and a controller that is configured to enable the low frequency driver to acoustically output sound in a first frequency range and enable the high frequency driver to acoustically output sound in a second frequency range, the second frequency range being higher than the first frequency range.

21. The headphone of claim 20, wherein the low frequency driver is located outside of the pinna when viewed in the sagittal plane.

22. The headphone of claim 21, further comprising a body that covers a portion of the pinna when viewed from the sagittal plane.

23. The headphone of claim 22, wherein the high frequency driver is carried by the body.

* * * * *